US009624622B2

(12) United States Patent
Müller et al.

(10) Patent No.: US 9,624,622 B2
(45) **Date of Patent: *Apr. 18, 2017**

(54) FLAME RETARDANT CARPET PRODUCTS WITH COATING AND/OR ADHESIVE LAYERS FORMED FROM VINYL ACETATE/ETHYLENE COPOLYMER DISPERSIONS

(75) Inventors: Harmin Müller, Hofheim (DE); Paul Stuart Wormald, Frankfurt (DE); Paolo Bavaj, Frankfurt (DE)

(73) Assignee: CELANESE SALES GERMANY GMBH, Sulzbach (DE)

( * ) Notice: Subject to any disclaimer, the term of this patent is extended or adjusted under 35 U.S.C. 154(b) by 915 days.

This patent is subject to a terminal disclaimer.

(21) Appl. No.: 13/811,956

(22) PCT Filed: Aug. 12, 2011

(86) PCT No.: PCT/IB2011/002644

§ 371 (c)(1),
(2), (4) Date: Mar. 6, 2013

(87) PCT Pub. No.: WO2012/020319

PCT Pub. Date: Feb. 16, 2012

(65) Prior Publication Data

US 2013/0156997 A1 Jun. 20, 2013

Related U.S. Application Data

(60) Provisional application No. 61/373,091, filed on Aug. 12, 2010, provisional application No. 61/481,459, filed on May 2, 2011.

(51) Int. Cl.
*D06N 7/00* (2006.01)

(52) U.S. Cl.
CPC ..... *D06N 7/0063* (2013.01); *D06N 7/0073* (2013.01); *D06N 2203/042* (2013.01); *D06N 2209/067* (2013.01); *Y10T 428/23921* (2015.04)

(58) Field of Classification Search
CPC ..... D06N 7/0073; D06N 2203/045; D06N 2203/042; D06N 2205/02; D06N 2205/023; D06N 2209/106; Y10T 428/23979; Y10T 428/23986
USPC ..... 428/96, 95
See application file for complete search history.

(56) References Cited

U.S. PATENT DOCUMENTS

| | | | | |
|---|---|---|---|---|
| 4,239,563 | A | 12/1980 | Iacovielo | |
| 4,689,256 | A | 8/1987 | Slosberg et al. | |
| 4,735,986 | A | 4/1988 | Iacovielo | |
| 5,026,765 | A | 6/1991 | Katz et al. | |
| 5,849,389 | A | 12/1998 | Lunsford | |
| 6,359,076 | B1 | 3/2002 | Lunsford et al. | |
| 7,056,847 | B2 | 6/2006 | Walker et al. | |
| 7,582,699 | B2 | 9/2009 | Walker et al. | |
| 7,649,067 | B2 | 1/2010 | Zecha et al. | |
| 8,053,511 | B2 * | 11/2011 | Muller | C08F 2/24 524/556 |
| 2005/0287336 | A1 * | 12/2005 | Lunsford | C09D 131/04 428/97 |
| 2008/0039572 | A1 * | 2/2008 | Mueller | C08F 218/08 524/457 |
| 2010/0271805 | A1 * | 10/2010 | Van Herpen | D05C 17/02 362/84 |
| 2012/0009379 | A1 * | 1/2012 | Muller | C08F 218/08 428/96 |
| 2014/0349060 | A1 * | 11/2014 | Mueller | D06N 7/0073 428/96 |

FOREIGN PATENT DOCUMENTS

| | | | | |
|---|---|---|---|---|
| DE | 10240332 | A1 * | 5/2004 | A47G 27/0412 |
| DE | CA 2751821 | A1 * | 8/2010 | C08F 218/08 |
| EP | 0432391 | A2 | 6/1991 | |
| EP | 0263267 | A2 | 4/1998 | |
| EP | 0864685 | A2 | 9/1998 | |
| EP | 1008689 | A2 | 6/2000 | |
| EP | 2088162 | A1 | 8/2009 | |

(Continued)

OTHER PUBLICATIONS

International Search Report and Written Opinion of ISA issued in corresponding PCT/IB2011/002644.

*Primary Examiner* — Cheryl Juska
(74) *Attorney, Agent, or Firm* — Roberts Mlotkowski Safran Cole & Calderon P.C.

(57) ABSTRACT

Disclosed are carpet products comprising at least one flexible substrate and at least one coating and/or adhesive layer associated with the at least one flexible substrate. The coating and/or adhesive layer is formed from an aqueous composition comprising: A) an emulsifier-stabilized vinyl acetate/ethylene (VAE) emulsion copolymer dispersion and B) at least one particulate filler material selected from particulate inorganic compounds and particulate plastic material. The vinyl acetate/ethylene copolymer in the copolymer dispersion has a selected ethylene content or glass transition temperature. It is also preferably substantially free of cross-linkable co-monomer moieties which generate formaldehyde upon curing and preferably has a particle size, $d_w$, ranging from about 50 to about 500 nm. The carpet product is substantially free of polyvinyl chloride and bitumen and exhibits a Class B1 flame-retardancy in accordance with DIN 4102-14, corresponding to a critical heat flux of ≥about 4.5 kW/m$^2$.

18 Claims, No Drawings

(56) References Cited

FOREIGN PATENT DOCUMENTS

| | | | |
|---|---|---|---|
| GB | 1408894 | A | 10/1975 |
| WO | 2007075279 | A1 | 7/2007 |
| WO | 2008054614 | A1 | 5/2008 |
| WO | 2010089142 | A1 | 8/2010 |
| WO | 2011139267 | A1 | 11/2011 |
| WO | 2011140065 | A2 | 11/2011 |
| WO | 2012020321 | A2 | 2/2012 |

* cited by examiner

FLAME RETARDANT CARPET PRODUCTS WITH COATING AND/OR ADHESIVE LAYERS FORMED FROM VINYL ACETATE/ETHYLENE COPOLYMER DISPERSIONS

CROSS-REFERENCE TO RELATED APPLICATIONS

The present Application is a U.S. National Phase of PCT/IB2011/002644 filed on Aug. 12, 2011, which claims priority to US provisional Application having Ser. No. 61/373,091; Filed Aug. 12, 2010 and the U.S. Provisional Patent Application having Ser. No. 61/481,459; Filed May 2, 2011. The benefit of the filing dates of both of these provisional patent applications is claimed under the Paris Convention and under 35 USC §119(e). The disclosures of the PCT and Provisional Patent Applications are hereby incorporated by reference into the present Application.

FIELD

The present development relates to carpet products having one or more coating and/or adhesive layers therein which comprise a filler-containing, emulsifier- and/or colloid-stabilized vinyl ester ethylene copolymer-containing dispersion as an emulsion binder. These carpet products exhibit desirably low flammability and smoke generation characteristics. Such flame retardancy can be achieved without post addition of any external conventional flame retardant additives such as alumina trihydrate (ATH).

BACKGROUND

Most conventional carpets comprise a primary backing with yarn tufts in the form of cut or uncut loops extending upwardly from this backing to form a pile surface. For tufted carpets, the yarn is inserted into a primary backing (frequently a woven or nonwoven substrate) by tufting needles and a pre-coat (i.e., a binder) is applied thereto.

Many residential and commercial carpets are also manufactured with a woven scrim (typically made from polypropylene) attached to the back of the carpet to provide dimensional stability to the carpet. These are dual layer products, where two coating layers (precoat for tuft anchorage and adhesive for scrim fixation) are added wet, and the scrim is added afterwards. After fixation of the scrim, the carpet is cured at 130-200° C. for a certain time.

For both the pre-coat and the adhesive layer, the physical properties of the binder are important to their successful utilization as carpet coatings. In this regard, there are a number of important requirements which must be met by such coatings. The coating must be capable of being applied to the carpet and dried using the processes and equipment conventionally employed in the carpet industry for latex, e.g. emulsion, coating. The binder composition must provide excellent adhesion to the pile fibers to secure them firmly in the backing. The coating will also typically have a high loading of fillers such as calcium carbonate, clay, barite, feldspar, cullet, fly ash and/or recycled carpet backing. Further, coatings used as adhesives must also be able to secure substrates to the carpet secondary backing, thereby enabling the preparation of material for use in wall-to-wall carpeting.

The binders in coating and adhesive compositions for carpet materials are frequently emulsion polymers, i.e., latex dispersions, such as styrene-based emulsion copolymers like styrene-butadiene latex (SBL) materials or such as acrylic polymer latex dispersions. U.S. Pat. No. 4,689,256, for example, discloses flame retardant carpet products comprising an acrylic polymer latex used with a polyvinyl chloride (PVC) backing layer.

Copolymers of vinyl esters (such as vinyl acetate and vinyl verstate) and vinyl ester/ethylene can also be used and can frequently have cost and performance advantages such as flame retardancy over styrene-based coatings and adhesives such as SBL. For example, vinyl ester copolymers can be used to provide carpet products which are desirably low in VOC (volatile organic compound) content and which do not contain potentially toxic materials such as 4-phenyl cyclohexene (4-PCH) and related compounds which can be found in styrene-butadiene-based polymer dispersions. Vinyl ester copolymers form carpet coating and adhesive layers which are also advantageously resistant to degradation by visible light and/or ultraviolet (UV) radiation.

Emulsion binders and carpet coating compositions based on vinyl ester/ethylene, e.g., vinyl acetate/ethylene (VAE), copolymers are disclosed, for example, in WO 2010/089142 and in U.S. Pat. Nos. 4,735,986; 5,026,765; 5,849,389; 6,359,076; 7,056,847; 7,582,699; 7,649,067; and in U.S. Patent Application Publication No. 2005/0287336. Some of these patent documents note that such VAE binders and coating compositions are compatible with polyvinyl chloride (PVC) plastisols which are frequently used as backing layers in such carpet products.

The vinyl ester/ethylene copolymers used in the binders and coating compositions described in the foregoing patent documents are prepared by polymerizing appropriate co-monomers in an aqueous emulsion. Such emulsions or dispersions can be stabilized by adding conventional surfactants (anionic, nonionic, cationic) as emulsifiers. Such emulsions or dispersions may also be stabilized by including protective colloids.

Notwithstanding the availability of a variety of carpet coating and adhesive compositions based on stabilized vinyl ester and vinyl ester/ethylene (e.g., VAE) latex emulsion/dispersion binders, it would be advantageous to configure specific types of medium hard (as quantified by copolymer glass transition temperature, $T_g$), vinyl ester- and VAE-based, filler-containing, environmentally friendly binder emulsions/dispersions which exhibit a desirable balance of properties that make them especially useful in preparing textile structures such as carpets and carpet material. The present development provides carpet products of especially desirable low flammability and low smoke generation properties without adding any external flame retardant additives. This offers the carpet producer the advantage of reduced formulation complexity combined with cost and use benefits. Such carpet products can also be desirably low in volatile organic compound (VOC) content and are advantageously resistant to degradation by light and UV radiation. The carpet products described herein with their VAE-based coatings, binders and adhesives having a selected combination of features (e.g., specific co-monomers, cross-linkers, stabilizers, polymer particle sizes, $T_g$'s, and fillers) can provide such a desirable balance of properties, especially when compared to carpet products using state-of-the-art SBL-based carpet binder and adhesive coatings.

SUMMARY

The present development is directed to carpet products comprising at least one flexible substrate and at least one coating and/or adhesive layer associated with the at least one flexible substrate. The coating and/or adhesive layer(s) are formed from an aqueous composition comprising: A) an emulsifier-stabilized vinyl acetate/ethylene (VAE) copolymer dispersion, and B) at least one particulate filler material selected from particulate inorganic compounds and particulate plastic material.

The vinyl acetate/ethylene copolymer in the copolymer dispersion comprises main co-monomers which include vinyl acetate, which is copolymerized with ethylene and optionally also with one or more additional different non-functional main co-monomer(s) which can be vinyl esters of $C_1$-$C_{18}$ mono-carboxylic acids or $C_1$-$C_{18}$ esters of ethylenically unsaturated mono-carboxylic acids or $C_1$-$C_{18}$ diesters of ethylenically unsaturated di-carboxylic acids. This vinyl acetate/ethylene copolymer furthermore has a glass transition temperature, $T_g$, between about −20° C. to about +20° C. Alternatively, the vinyl acetate/ethylene copolymer will have an ethylene content of from about 4 wt % to about 30 wt %, preferably about 8 wt % to about 15 wt %, based on the total of the main co-monomers in the copolymer.

The vinyl ester/ethylene copolymer in the copolymer dispersion will also preferably contain minor amounts of cross-linking co-monomers such as those based on epoxides or silanes. The VAE copolymer, however, will preferably be substantially free of cross-linkable co-monomer moieties such as N-methylolacrylamide (NMA or NMA-LF) which generate even small amounts of formaldehyde upon formation of the coating or adhesive layer in the carpet product.

The copolymer dispersion preferably has a particle size, $d_w$, ranging from about 50 to about 500 nm, as determined by Laser Aerosol Spectroscopy. Such a dispersion is preferably stabilized with at least about 0.5 wt %, based on total main monomers in the copolymer, of one or more, preferably nonionic and/or anionic, emulsifiers and from about 0 wt % up to about 3 wt %, based on total main monomers in the copolymer, of a protective colloid such as polyvinyl alcohol or hydroxyethylcellulose.

The carpet product itself must also be substantially free of polyvinyl chloride and bitumen. Furthermore, the carpet products described herein, in the substantial absence of alumina trihydrate or equivalent flame retardancy-imparting material, will exhibit in accordance with DIN 4102-14 (or EN ISO 9239-1 2008), Class B 1 flame-retardancy corresponding to a critical heat flux of ≥4.5 kW/m$^2$ and preferably also a self extinction of burning time of less than about 700 seconds; a maximum burning length of less than about 300 mm; and a smoke density value of less than about 200%-minutes.

DETAILED DESCRIPTION

The carpet products described herein will essentially comprise at least one flexible substrate and at least one coating and/or adhesive layer associated with the flexible substrates(s). The adhesive or coating layer(s) is/are formed from an aqueous composition containing a specific type of vinyl ester-based copolymer dispersion as the coating- or film-forming component thereof, together with a particulate filler material. The components and preparation of the layer-forming aqueous composition, the copolymer dispersion and filler components thereof, the flexible, e.g., textile, substrate(s) and the preparation and characteristics of carpet products comprising all of these components are described in detail below:

Copolymer Dispersion

The film- or coating-forming component of the aqueous compositions applied to carpet flexible substrates(s) herein is a vinyl acetate-based copolymer comprising ethylene and optionally one or more additional non-functional main co-monomers. This vinyl acetate/ethylene copolymer is present in a copolymer dispersion prepared by the emulsion polymerization of appropriately selected co-monomers.

The primary co-monomer used in the preparation of the copolymer dispersion is vinyl acetate. This primary vinyl acetate co-monomer is generally present in the copolymer of the dispersion in amounts of from about 40% to about 80% by weight, more preferably from about 60% to 70% by weight, based on the total main co-monomers in the copolymer. The second essential co-monomer for incorporation into the copolymer of the dispersion is ethylene. The ethylene will generally comprise from about 4% to about 30% by weight, preferably 8% to about 25% by weight, most preferably from about 10% to about 20% by weight, based on the total main co-monomers in the copolymer.

The vinyl acetate/ethylene copolymer of the copolymer dispersion can optionally comprise one or more additional non-functional main co-monomers besides vinyl acetate and ethylene. One type of such optional main non-functional co-monomer comprises vinyl ester co-monomers. Examples thereof are vinyl esters of monocarboxylic acids having one to eighteen carbon atoms (except vinyl acetate), e.g. vinyl formate, vinyl propionate, vinyl butyrate, vinyl isobutyrate, vinyl benzoate, vinyl-2-ethyl-hexanoate, vinyl esters of an [alpha]-branched carboxylic acid having 5 to 11 carbon atoms in the acid moiety, e.g., Versatic™ acids, and the vinyl esters of pivalic, 2-ethylhexanoic, lauric, paimitic, myristic, and stearic acid. Vinyl esters of Versatic™ acids, more particularly VeoVa™ 9, VeoVa™ 10, and VeoVa™ 11, are preferred.

Another type of optional main non-functional co-monomer which can be incorporated into the vinyl acetate/ethylene copolymer of the dispersion comprises esters of ethylenically unsaturated mono-carboxylic acids or diesters of ethylenically unsaturated di-carboxylic acids. Particularly advantageous co-monomers of this type are the esters of alcohols having one to eighteen carbon atoms. Examples of such non-functional, main co-monomers include methyl methacrylate or acrylate, butyl methacrylate or acrylate, 2-ethylhexyl methacrylate or acrylate, dibutyl maleate and/or dioctyl maleate.

Combinations of two or more of the forgoing optional non-functional main co-monomer types can be co-polymerized into the vinyl acetate/ethylene copolymer. If present, such non-functional main co-monomers can comprise up to about 40 wt % based on total main co-monomers in the copolymer. More preferably, such non-functional main co-monomers can comprise from about 5 wt % to about 20 wt %, based on the total main co-monomers in the vinyl acetate/ethylene copolymer.

The vinyl acetate/ethylene emulsion copolymer used in the carpet products herein can also optionally contain relatively minor amounts of other types of co-monomers besides vinyl acetate, ethylene or other main co-monomer types. Such other optional co-monomers will frequently be those which contain one or more functional groups and can serve to provide or facilitate cross-linking between copolymer chains within the copolymer dispersion-containing aqueous composition, or upon the drying or curing of films and coatings formed from such compositions.

Such optionally present, functional co-monomers can include ethylenically unsaturated acids, e.g. mono- or di-carboxylic acids, sulfonic acids or phosphonic acids. In place of the free acids, it is also possible to use their salts, preferably alkali metal salts or ammonium salts. Examples of optional functional co-monomers of this type include acrylic acid, methacrylic acid, crotonic acid, maleic acid, fumaric acid, itaconic acid, vinylsulfonic acid, vinylphosphonic acid, styrenesulfonic acid, monoesters of maleic and/or fumaric acid, and of itaconic acid, with monohydric aliphatic saturated alcohols of chain length $C_1$-$C_{18}$, and also their alkali metal salts and ammonium salts, or (meth)acrylic esters of sulfoalkanols, an example being sodium 2-sulfoethyl methacrylate.

Other types of suitable optional functional co-monomers include ethylenically unsaturated co-monomers with at least one amide-, epoxy-, hydroxyl, trialkoxysilane- or carbonyl group. Particularly suitable are ethylenically unsaturated epoxide compounds, such as glycidyl methacrylate or glycidyl acrylate. Also suitable are hydroxyl compounds including methacrylic acid and acrylic acid $C_1$-$C_9$ hydroxyalkyl esters, such as n-hydroxyethyl, n-hydroxypropyl or n-hydroxybutyl acrylate and methacrylate. Other suitable fucntionla co-momers include compounds such as diacetone acrylamide and acetylacetoxyethyl acrylate and methacrylate; and amides of ethylenically unsaturated carboxylic acids, such as acrylamide or meth acrylamide.

As noted, the emulsion copolymer used herein can optionally contain trialkoxysilane functional co-monomers. Alternatively, the emulsion copolymers used herein can be substantially free of silane-based co-monomers.

One type of functional co-monomer which should not be incorporated into the vinyl acetate/ethylene copolymers used herein comprises any co-monomer which contains cross-linkable moieties that generate formaldehyde upon formation of the coating or adhesive layer from compositions containing such copolymers. Thus the vinyl acetate/ethylene copolymer in the copolymer dispersion should be substantially free of such co-monomers, which include, for example, common cross-linkers like N-methylolacrylamide (NMA) or even low formaldehyde versions of N-methylolacrylamide such as NMA-LF.

Optional functional co-monomers can be incorporated into the vinyl acetate/ethylene emulsion copolymers used herein in amount of up to about 5 wt %, based on total main co-monomers in the copolymer. More preferably, optional functional co-monomers can comprise from about 0.5 wt % to about 2 wt %, based on total main co-monomers in the copolymer.

The emulsion copolymer can be formed within the copolymer dispersion using emulsion polymerization techniques described more fully hereinafter. Within the copolymer dispersion, the copolymer will be present in the form of particles ranging in weight average particle size, $d_w$, of from about 50 nm to about 500 nm, measured by laser aerosol sprectroscopy. More preferably, the copolymer dispersion will be present in the form of particles ranging in weight average particle size, $d_w$, of from about 120 nm to about 350 nm. Particle size can be determined by means of laser aerosol spectroscopy techniques.

Depending upon co-monomer type, solubility and the monomer feeding techniques employed, the vinyl ester-ethylene based copolymer can be either homogeneous or heterogeneous in monomeric configuration and make-up. Homogeneous copolymers will have a single discreet glass transition temperature, $T_g$, as determined by differential scanning calorimetry techniques. Heterogeneous copolymers will exhibit two or more discreet glass transition temperatures and might lead to core shell particle morphologies. Whether homogeneous or heterogeneous, the vinyl ester-based copolymer used herein will have glass transition temperatures, $T_g$, which range between about −20° C. and +20° C., more preferably between about −10° C. and +15° C. As is known, the $T_g$ of the polymer can be controlled, for example, by adjusting the ethylene content, i.e., generally the more ethylene present in the copolymer relative to other co-monomers, the lower the $T_g$.

Stabilizers for Polymer Dispersions

Both during polymerization and thereafter, the copolymer dispersion used to prepare the aqueous compositions that form the carpet adhesive or coating layers is stabilized in the form of an aqueous copolymer dispersion or latex. The copolymer dispersion therefore will be prepared in the presence of and will contain a stabilization system which generally comprises emulsifiers, in particular nonionic emulsifiers and/or anionic emulsifiers. Mixtures of nonionic and anionic emulsifiers can also be employed.

The amount of emulsifier employed will generally be at least 0.5 wt %, based on the total quantity of main co-monomers in the copolymer dispersion. Generally emulsifiers can be used in amounts up to about 8 wt %, based on the total quantity of main co-monomers in the copolymer dispersion. The weight ratio of emulsifiers nonionic to anionic may fluctuate within wide ranges, between 1:1 and 50:1 for example. The vinyl acetate/ethylene copolymer dispersion may further comprise small amounts of polymeric stabilizers (protective colloids).

Emulsifiers employed with preference herein are nonionic emulsifiers having alkylene oxide groups and/or anionic emulsifiers having sulfate, sulfonate, phosphate and/or phosphonate groups. Such emulsifiers, if desired, can be used together with molecularly or dispersely water-soluble polymers, preferably together with polyvinyl alcohol. Preferably also the emulsifiers used contain no alkylphenolethoxylates (APEO).

Examples of suitable nonionic emulsifiers include acyl, alkyl, oleyl, and alkylaryl ethoxylates. These products are commercially available, for example, under the name Genapol®, Lutensol® or Emulan®. They include, for example, ethoxylated mono-, di-, and tri-alkylphenols (EO degree: 3 to 50, alkyl substituent radical: $C_4$ to $C_{12}$) and also ethoxylated fatty alcohols (EO degree: 3 to 80; alkyl radical: $C_8$ to $C_{36}$), especially $C_{12}$-$C_{14}$ fatty alcohol (3-40) ethoxylates, $C_{13}$-$C_{15}$ oxo-process alcohol (3-40) ethoxylates, $C_{16}$-$C_{18}$ fatty alcohol (11-80) ethoxylates, $C_{1-10}$ oxo-process alcohol (3-40) ethoxylates, $C_{13}$ oxo-process alcohol (3-40) ethoxylates, polyoxyethylenesorbitan monooleate with 20 ethylene oxide groups, copolymers of ethylene oxide and propylene oxide having a minimum ethylene oxide content of 10% by weight, the polyethylene oxide (4-40) ethers of oleyl alcohol, and the polyethene oxide (4-40) ethers of nonylphenol. Particularly suitable are the polyethylene oxide (4-40) ethers of fatty alcohols, more particularly of oleyl alcohol, stearyl alcohol or $C_{11}$ alkyl alcohols.

The amount of nonionic emulsifiers used in preparing the copolymer dispersions herein is typically about 1% to about 8% by weight, preferably about 1% to about 5% by weight, more preferably about 1% to about 4% by weight, based on the total main monomer quantity. Mixtures of nonionic emulsifiers can also be employed.

Examples of suitable anionic emulsifiers include sodium, potassium, and ammonium salts of linear aliphatic carboxylic acids of chain length $C_{12}$-$C_{20}$, sodium hydroxyoctadecanesulfonate, sodium, potassium, and ammonium salts of hydroxy fatty acids of chain length $C_{12}$-$C_{20}$ and their sulfonation and/or sulfation and/or acetylation products, alkyl sulfates, including those in the form of triethanolamine salts, alkyl($C_{10}$-$C_{20}$) sulfonates, alkyl($C_{10}$-$C_{20}$) arylsulfonates, dimethyl-dialkyl ($C_8$-$C_{18}$) ammonium chloride, and their sulfonation products, lignosulfonic acid and its calcium, magnesium, sodium, and ammonium salts, resin acids, hydrogenated and dehydrogenated resin acids, and their alkali metal salts, dodecylated sodium diphenyl ether disulfonate, sodium lauryl sulfate, sulfated alkyl or aryl ethoxylate with EO degree between 1 and 10, for example ethoxylated sodium lauryl ether sulfate (EO degree 3) or a salt of a bisester, preferably of a bis-$C_4$-$C_{18}$ alkyl ester, of a sulfonated dicarboxylic acid having 4 to 8 carbon atoms, or a mixture of these salts, preferably sulfonated salts of esters of succinic acid, more preferably salts, such as alkali metal salts, of bis-$C_4$-$C_{18}$ alkyl esters of sulfonated succinic acid, or phosphates of polyethoxylated alkanols or alkylphenols.

The amount of anionic emulsifiers used can typically range from about 0.1% to about 3.0% by weight, preferably from about 0.2% to about 2.0% by weight, more preferably from about 0.5% to about 1.5% by weight, based on the total main monomer quantity. Mixtures of anionic emulsifiers can also be employed.

Along with emulsifiers, the vinyl ester/ethylene copolymer dispersions employed in accordance with the invention may comprise as part of the stabilizer system protective colloids, preferably polyvinyl alcohols and/or their modifications. Protective colloids, if present, are generally present only in comparatively low concentrations, as for example at up to about 3% by weight, based on the total amount of the main monomers used. The vinyl acetate/ethylene copolymer dispersions employed herein will more preferably contain no protective colloids or only up to about 1% by weight of protective colloids, based on the total amount of the main co-monomers employed in the vinyl acetate/ethylene copolymer.

Examples of suitable protective colloids include water-soluble or water-dispersible polymeric modified natural substances, such as cellulose ethers, examples being methyl-, ethyl-, hydroxyethyl- or carboxymethylcellulose; water-soluble or water-dispersible polymeric synthetic substances, such as polyvinylpyrrolidone or polyvinyl alcohols or their copolymers (with or without residual acetyl content), and polyvinyl alcohol which is partially esterified or acetalized or etherified with saturated radicals, and also with different molecular weights.

The protective colloids can be used individually or in combination. In the case of combinations, the two or more colloids can each differ in their molecular weights or they can differ in their molecular weights and in their chemical composition, such as the degree of hydrolysis, for example.

In addition to the emulsifiers and, if appropriate, protective colloids that are used during the emulsion polymerization of the copolymers herein, it is also possible for the vinyl acetate/ethylene copolymer dispersions used herein to contain subsequently added water-soluble or water-dispersible polymers as hereinafter described. Additional emulsifiers may also be added to the dispersions post-polymerization.

Copolymer Dispersion Preparation

The copolymer dispersions comprising the vinyl acetate/ethylene copolymers described herein can be prepared using emulsion polymerization procedures which result in the preparation of polymer dispersions in aqueous latex form. Such preparation of aqueous polymer dispersions of this type is well known and has already been described in numerous instances and is therefore known to the skilled artisan. Such procedures are described, for example, in U.S. Pat. No. 5,849,389, and in the *Encyclopedia of Polymer Science and Engineering*, Vol. 8, p. 659 ff (1987). The disclosures of both of these publications are incorporated herein by reference in their entirety.

The polymerization may be carried out in any manner known per se in one, two or more stages with different monomer combinations, giving polymer dispersions having particles with homogeneous or heterogeneous, e.g., core shell or hemispheres, morphology. Any reactor system such as batch, loop, continuous, cascade, etc, may be employed.

The polymerization temperature generally ranges from about 20° C. to about 150° C., more preferably from about 50° C. to about 120° C. The polymerization generally takes place under pressure if appropriate, preferably from about 2 to about 150 bar, more preferably from about 5 to about 100 bar.

In a typical polymerization procedure involving, for example, vinyl acetate/ethylene copolymer dispersions, the vinyl acetate, ethylene, and other co-monomers can be polymerized in an aqueous medium under pressures up to about 120 bar in the presence of one or more initiators and at least one emulsifying agent, optionally along with protective colloids like PVOH. The aqueous reaction mixture in the polymerization vessel can be maintained by a suitable buffering agent at a pH of about 2 to about 7.

The manner of combining the several polymerization ingredients, i.e., emulsifiers, co-monomers, catalyst system components, etc., can vary widely. Generally an aqueous medium containing at least some of the emulsifier(s) can be initially formed in the polymerization vessel with the various other polymerization ingredients being added to the vessel thereafter.

Co-monomers can be added to the polymerization vessel continuously, incrementally or as a single charge addition of the entire amounts of co-monomers to be used. Co-monomers can be employed as pure monomers or can be used in the form of a pre-mixed emulsion. Ethylene as a co-monomer can be pumped into the polymerization vessel and maintained under appropriate pressure therein.

As noted, the polymerization of the ethylenically unsaturated monomers will generally take place in the presence of at least one initiator for the free-radical polymerization of these co-monomers. Suitable initiators for the free-radical polymerization, for initiating and continuing the polymerization during the preparation of the dispersions, include all known initiators which are capable of initiating a free-radical, aqueous polymerization in heterophase systems. These initiators may be peroxides, such as alkali metal and/or ammonium peroxodisulfates, or azo compounds, more particularly water-soluble azo compounds.

As polymerization initiators, it is also possible to use what are called redox initiators. Examples thereof are tert-butyl hydroperoxide and/or hydrogen peroxide in combination with reducing agents, such as with sulfur compounds, an example being the sodium salt of hydroxymethanesulfinic acid, Brüggolit FF6 and FF7, Rongalit C, sodium sulfite, sodium disulfite, sodium thiosulfate, and acetone-bisulfite adduct, or with ascorbic acid, sodium erythobate, or with reducing sugars.

The amount of the initiators or initiator combinations used in the process varies within what is usual for aqueous polymerizations in heterophase systems. In general the amount of initiator used will not exceed 5% by weight, based on the total amount of the co-monomers to be polymerized. The amount of initiators used, based on the total amount of the co-monomers to be polymerized, is preferably 0.05% to 2.0% by weight.

In this context, it is possible for the total amount of initiator to be included in the initial charge to the reactor at the beginning of the polymerization. Preferably, alternatively, a portion of the initiator is included in the initial charge at the beginning, and the remainder is added after the polymerization has been initiated, in one or more steps or continuously. The addition may be made separately or together with other components, such as emulsifiers or monomer emulsions. It is also possible to start the emulsion polymerization using a seed latex, for example with about 0.5 to about 15% by weight of the dispersion.

In addition to the emulsion polymerized vinyl acetate/ethylene copolymer, the copolymer dispersions used herein can additionally contain copolymers formed from $C_1$-$C_{18}$ esters of (meth) acrylic acids, $C_1$-$C_{18}$ esters of other ethylenically unsaturated mono-carboxylic acids, or $C_1$-$C_{18}$ diesters of ethylenically unsaturated di-carboxylic acids. Such additional copolymers can comprise, for example, from about 0.5 to about 20 parts by weight based on total copolymers in the copolymer dispersion and can include copolymers formed from ethyl acrylate, butyl acrylate (BuA), 2-ethylhexyl acrylate (2-EHA), dibutyl maleate, dioctyl maleate or combinations of these esters.

The molecular weight of the various copolymers in the copolymer dispersions herein can be adjusted by adding small amounts of one or more molecular weight regulator substances. These regulators, as they are known, are generally used in an amount of up to 2% by weight, based on the total co-monomers to be polymerized. As regulators, it is possible to use all of the substances known to the skilled artisan. Preference is given, for example, to organic thio compounds, silanes, allyl alcohols, and aldehydes.

The copolymer dispersions as prepared herein will generally have a viscosity which ranges from about 100 mPas to about 5000 mPas at 45-55% solids, more preferably from about 200 mPas to about 4000 mPas, most preferably 400-3000 mPas measured with a Brookfield viscometer at 25° C., 20 rpm, with appropriate spindle. Viscosity may be adjusted by the addition of thickeners and/or water to the copolymer dispersion. Suitable thickeners can include polyacrylates or polyurethanes, such as Borchigel L75® and Tafigel PUR 60®. Alternatively, the copolymer dispersion may be substantially free of thickeners.

Following polymerization, the solids content of the resulting aqueous copolymer dispersions can be adjusted to the level desired by the addition of water or by the removal of water by distillation. Generally, the desired level of polymeric solids content after polymerization is from about 40 weight percent to about 70 weight percent based on the total weight of the polymer dispersion, more preferably from about 45 weight percent to about 55 weight percent.

The aqueous copolymer dispersions used to form the coating or adhesive layer-forming compositions herein can be desirably low in Total Volatile Organic Compound (TVOC) content. A volatile organic compound is defined herein as a carbon containing compound that has a boiling point below 250° C. (according to the ISO 11890-2 method for polymer dispersions TVOC content determination) at atmospheric pressure. Compounds such as water and ammonia are excluded from VOCs.

The aqueous copolymer dispersions used herein will generally contain less than 3% TVOC by weight based on the total weight of the aqueous copolymer dispersion. Preferably the aqueous copolymer dispersion will contain less than 1% TVOC by weight based on the total weight of the aqueous copolymer dispersion; more preferably the aqueous copolymer dispersion will contain less than 0.5% TVOC by weight based on the total weight of the aqueous copolymer dispersion, most preferable below 0.3% TVOC according to ISO 11890-2, described hereinafter in the Test Methods section.

The aqueous copolymer dispersions used herein will generally also emit a relatively small amount of its TVOC content when exposed to the atmosphere. In particular, the copolymer dispersions herein will emit TVOC materials to the extent of no more than about 15 times the Toluene D8 standard, when films formed from such dispersions are tested in accordance with the procedures of ISO 16000-9, described hereinafter in the Test Methods section. More preferably, the copolymer dispersions herein will emit TVOC materials to the extent of no more than about 10 times the Toluene D8 standard.

Where appropriate, the vinyl acetate/ethylene copolymer dispersions used herein can also optionally comprise a wide variety of conventional additives which are typically used in the formulation of binders and/or adhesives. Such optional additives may be present in the copolymer dispersion from the beginning of or during polymerization, may be added to the dispersion post-polymerization or, such as in the case of fillers, may be used in connection with preparation of the aqueous coating compositions from the copolymer dispersions as hereinafter described.

Typical conventional optional additives for the copolymer dispersions herein can include, for example, film-forming assistants, such as white spirit, Texanol®, TxiB®, butyl glycol, butyl diglycol, butyl dipropylene glycol, and butyl tripropylene glycol; wetting agents, such as AMP 90®, TegoWet.280®, Fluowet PE®; defoamers, such as mineral oil defoamers or silicone defoamers; UV protectants, such as Tinuvin 1130®; agents for adjusting the pH; preservatives; plasticizers, such as dimethyl phthalate, diisobutyl phthalate, diisobutyl adipate, Coasol B®, Plastilit 3060®, and Triazetin®; subsequently added stabilizing polymers, such as polyvinyl alcohol or cellulose ethers; and other additives and auxiliaries of the kind typical for the formulation of binders and adhesives. The amounts of these additives used in the VAE copolymer dispersions herein can vary within wide ranges and can be selected by the specialist in view to the desired area of application.

Aqueous Coating and Adhesive Compositions

The copolymer dispersions as hereinbefore described are combined with filler material and additional water to form aqueous coating and/or adhesive compositions. Such coating/adhesive compositions are applied to the textile substrate (s) which form the carpet products herein. Upon drying, the applied aqueous coating and/or adheive compositions then provide the coating and/or adhesive layers within the carpet products. The carpet product can comprise only one or more than one adhesive or coating layer.

In general, the carpet products herein will always contain a binder coating layer to secure the carpet fibers to a primary backing substrate. That binder coating layer can also serve as an adhesive layer if a scrim or other separate flexible secondary substrate is contacted with that binder coating layer prior to curing.

The carpet products herein can optionally also comprise a second separate layer which can be an adhesive layer to secure a secondary backing substrate to an already cured coated primary backing. In one embodiment, the carpet product can comprise both a binder coating layer and an adhesive layer which are formed from the same type of aqueous composition. Alternatively, the carpet products herein can comprise both a binder coating layer and an adhesive layer, wherein the two layers are formed from different aqueous compositions, with at least the binder coating layer, and preferably both layers, being formed from the type of VAE-based aqueous compositions described herein.

The aqueous coating and/or adhesive compositions will also contain a particulate filler material selected from particulate inorganic compounds and particulate plastic materials. Thus, the filler employed can be essentially any filler suitable for use in carpet manufacture. Such fillers are widely commercially available.

Filler examples include inorganic, e.g., mineral, fillers or pigments such as fly ash and ground glass and those known in the art, such as calcium carbonate, clay, kaolin, talc, barites, feldspar, titanium dioxide, calcium aluminum pigments, satin white, zinc oxide, barium sulphate, gypsum, silica, mica, and diatomaceous earth. Particulate plastic material such as synthetic polymer pigments, hollow polymer pigments and recycled carpet backing may also be employed, as can mixtures of any of the foregoing filler types. The preferred filler material is particulate calcium carbonate.

The particulate filler material can generally range in average particle size between about 200 nm and 1000 μm, more preferably between about 1 μm and 500 μm, most preferably 10 μm-300 μm. Preferred coating and/or adhesive compositions used to prepare carpet products in accordance with the present invention are loaded with filler to yield an aqueous coating and/or adhesive composition comprising from about 2.5 to about 50 weight percent, more preferably from about 10 to about 40 weight percent, and more preferably from about 20 to about 30 weight percent of dry copolymer and from about 50 to about 97.5 weight percent, preferably about 60 to about 90 weight percent, and most preferably from about 70 to 80 weight percent of filler based on total weight of solids in the aqueous composition, depending in part on the type and form of the carpet being constructed.

Such coating or adhesive compositions can contain in addition to the copolymer dispersions and filler materials hereinbefore described, a variety of additional conventional additives in order to modify the properties thereof. Among these additives may be included thickeners, rheology modifiers, dispersants, colorants, biocides, anti-foaming agents, etc. These optional additives are largely the same as those hereinbefore described with respect to the copolymer dispersions herein Carpet Products The coating compositions hereinbefore described form the coating, i.e., binder, and/or adhesive layer(s) in the carpet products herein which will also comprise at least one flexible substrate. Such flexible substrates can, for example, be selected from nonwovens, wovens, unidirectional weaves, knitted fabrics and pile fabrics. Thus the carpet products herein can be conventional tufted carpet, non-tufted carpet or needle-punched carpet. Such carpet products can be prepared by applying and drying the emulsion copolymer-containing aqueous compositions using equipment which is readily available in most carpet mills.

Pile carpet products comprise a primary backing with pile yarns extending from the primary backing substrate to form pile tufts. Pile or tufted carpet can be prepared by a) tufting or needling yarn into a woven or non-woven backing substrate; b) applying the aqueous carpet coating composition as described herein to the rear of the backing such that the yarn is embedded in the carpet coating composition; and c) drying the resultant carpet construction. In producing such tufted carpets, it is also desirable to apply a secondary backing to the primary backing either before or after drying of the carpet coating, depending upon the type of backing employed.

For tufted carpets, the primary backing substrate can be non-woven polypropylene, polyethylene or polyester or woven jute, polypropylene or poly amide (synthetic and natural). If a secondary backing is used, it is generally formed of woven or non-woven materials similar to those used as the primary backing and applied directly to the wet pre-coated primary backing prior to the drying step or applied with a separator adhesive to the dried pre-coated primary backing. Such a secondary backing provides dimensional stability to the carpet. The secondary backing also may be in the form of a preformed sheet polymer or copolymer. Suitable preformed sheet compositions include urethane polymers, polymers and copolymers of ethylene, propylene, isobutylene, and polyvinylbutyral.

The carpet products herein can also be non-tufted carpets wherein the fibers are embedded into a coating or binder composition which has been coated onto a woven or non-woven substrate. Non-tufted carpets also may be prepared by a) coating an aqueous composition such as hereinbefore described onto a substrate; b) embedding the carpet fibers in the substrate; and c) drying the resultant carpet construction. In forming a non-tufted carpet, the carpet coating can be thickened and applied to a scrim surface. The fibers then are directly embedded into the wet coating using conventional techniques and then dried. These non-tufted carpets also may be advantageously prepared utilizing a secondary backing that can provide additional dimensional stability.

In preparing the carpet products herein, the aqueous composition is applied in a manner such that it penetrates the fibers of the carpet yarns to yield better adhesion, fiber bundle integrity, anti-fuzzing properties and suitable tuft-bind values. Suitable carpet performance properties can be achieved by applying an amount of the aqueous coating/binder composition ranging from about 100 g/m$^2$ to about 3000 g/m$^2$, more preferably from about 200 g/m$^2$ to about 2000 g/m$^2$, and most preferably from about 400 g/m$^2$ to about 1500 g/m$^2$ (dry basis).

Certain Alternative Carpet Product Embodiments

In one specific carpet product embodiment, the carpet product will comprise a textile fabric stricture treated with a selected type of vinyl acetate/ethylene (VAE) copolymer dispersion. The textile fabric structure in such a carpet product can be in the form of a fabric selected from wovens, nonwovens, unidirectional weaves, knitted fabrics or pile fabrics. Specifically, the carpet product can comprise a pile fabric which is coated with a coating composition based on the selected type of VAE copolymer dispersion with the coating being on the far side of the pile and partially impregnated into the fabric. Alternatively, the carpet product can be in the form of a carpet wherein a secondary backing layer is bonded to the pile fabric layer on the far side of the tread side. The bonding between the two layers is effected through the VAE copolymer dispersion-based coating. Such textile fabric structures can have a weight per unit area of from about 1000 to about 3000 g/m$^2$.

The selected VAE copolymer dispersions used to treat the textile fabric structure in order to form such a carpet product embodiment can comprise from about 75 to about 85 pphm (parts per hundred of monomers) of vinyl acetate and from about 8 to about 15 pphm, more preferably from about 10 to 14 pphm, of ethylene. This copolymer will have a glass transition temperature, $T_g$, of from about +5° C. to about +15° C., more preferably between about +8° C. and +10° C., and a mean particle diameter, $d_w$, within the dispersion of about 200 to 600 nm.

Such a selected VAE copolymer can also comprise up to about 10 pphm of further co-monomers which are copolymerizable with the vinyl acetate and ethylene co-monomers. Such further co-monomers can include ethylenically unsaturated acids, or the salts thereof, ethylenically unsaturated monomers having at least one amide, epoxy, hydroxyl, N-methylol, trialkoxysilane or carbonyl group, and combinations of two or several monomers from any of these further monomer types. Alternatively, such further co-monomers can include vinyl esters which are not vinyl acetate, alpha-olefins which are not ethylene, vinyl aromatics, esters of ethylenically unsaturated monocarboxylic acids, and diesters of ethylenically unsaturated dicarboxylic acids.

The VAE copolymer dispersion used to make this carpet embodiment are stabilized with at least about 1 wt % of emulsifiers and about 1 wt % to about 2 wt % of a protective colloid based on polyvinyl alcohol. Preferably the emulsifiers used are selected from anionic and nonionic surfactants but contain no alkylphenylethoxylates (APEs). These VAE copolymer dispersions can have a viscosity of from about 400 to about 1600 mPa·s measured with a Brookfield viscometer at 25° C. Such dispersions can also have a solids content of from about 45 wt % to about 55 wt %.

Carpet Flame Retardant/Smoke Generation Characteristics

The carpet products herein have especially desirable flame retardancy and low smoke generation characteristics in comparison with carpet products made using other conventional coatings, binders and adhesives such as those based on styrene butadiene latex (SBL). The ability to load the aqueous coating/adhesive compositions used herein with high amounts of inorganic fillers such as calcium carbonate provides can enhance even further the superior flame retardancy and low smoke properties already exhibited by the vinyl acetate-based copolymer. Such flame retardant properties can be achieved for the carpet products herein even in the absence of added conventional flame retardant additives such as alumina trihydrate (ATH) and in the absence of polyvinyl chloride layers, or bitumen which are conventional components of flame retardant carpet products.

Even though the carpet products herein have excellent flame retardancy characteristics without the addition of conventional flame retardant additives, it is possible to enhance the flame retardant properties of the carpet products herein even further by utilizing such conventional flame retardant materials. Thus, even though not required for suitable flame retardant performance, the carpet products herein can optionally contain conventional amounts of conventional flame retardant additives such as phosphorus-containing compounds, antimony-containing compounds, metal halide-containing compounds, metal oxide-containing compounds, metal hydroxide-containing compounds, and combinations of these conventional flame retardant component types.

The flame retardancy and low smoke generation properties of the carpet products herein can be demonstrated by subjecting both model carpet backing layer films formed from the vinyl acetate/ethylene-based copolymer dispersions herein and the coating/adhesive layer-containing carpet products themselves to appropriate testing. Model carpet backing films, for example, can be tested for flame self-extinction time, maximum flame height, smoke emission and ash production in accordance with the procedures of DIN 4102-1, described hereinafter in the Test Methods section. Model backing films formed from the VAE-based copolymer dispersions herein will generally exhibit a flame self-extinction time of less than about 30 seconds, a maximum flame height of less than about 50 mm, a smoke emission rating of less than about 3 and an ash production rating of less than about 3 when tested in accordance with the procedures of DIN 4102-1.

The carpet products herein will also generally product exhibit a Class B 1 flame-retardancy, corresponding to a critical heat flux (CHF) of ≥about 4.5 kW/m$^2$, when tested in accordance with the procedures of DIN 4102-14, described hereinafter in the Test Methods section. More preferably, the carpet products herein will exhibit a flame retardancy corresponding to a critical heat flux (CHF) of more than about 6 kW/m$^2$, most preferably more than about 8 kW/m$^2$ when tested in accordance with DIN 4102-14. In addition, the carpet products herein will exhibit a self extinction of burning time of less than about 700 seconds and a maximum burning length of less than about 300 mm when tested in accordance with the procedures of DIN 4102-14 which relate to those parameters.

Further, the carpet products herein will generally exhibit low smoke generation propensity. Thus, the carpet products herein can have smoke density values of less than about 200%-minutes, and even more preferably less than about 100%-minutes, most preferably 50%-minutes, when tested in accordance with the DIN 4102-14 procedures which relate to smoke generation testing.

Additional Carpet Characteristics

The carpet products herein, with the specific type of vinyl acetate/ethylene-based copolymer dispersions used in forming coating and/or adhesive layers, also have especially desirable, environmentally friendly characteristics. The copolymer dispersions used, by virtue of containing no cross-linking groups which generate formaldehyde (e.g. no NMA or NMA-LF), and by virtue of their low TVOC content and TVOC emission, do not cause potentially problematic materials of this type to be emitted from the carpet products herein. The carpet products herein, in fact will generally emit TVOC materials to the extent of no more than about 5 times the Toluene D8 standard, when carpet products are tested in accordance with the procedures of ISO 16000-9, described hereinafter in the Test Methods section.

The carpet products herein must furthermore be substantially free of polyvinyl chloride and bitumen, two types of materials which typically have been used in flame retardant carpet products. Finally, since the carpet products herein do not utilize SBL coatings or binders, the carpet product will also be substantially free of potentially toxic components such as 4-phenylcyclohexene (4-PCH), 4-vinylcyclohexene (4-VCH), styrene, and ethylbenzene.

The carpet products herein, with the specific type of vinyl acetate/ethylene-based copolymers used in forming coating and/or adhesive layers, are also desirably resistant to degradation upon exposure to light having both visible and ultraviolet (UV) components. This can be demonstrated by testing the carpet products herein for both tuft anchorage (for example, in accordance with ISO 4919, described hereinafter in the Test Methods section) before and after prolonged exposure to visible light and/or UV radiation.

The carpet products herein, with the specific type of vinyl acetate/ethylene-based copolymers used in forming coating and/or adhesive layers, show a very good aging stability. This can be demonstrated by testing the carpet products herein for both tuft anchorage (for example, again in accordance with ISO 4919) before and after prolonged exposure to time and temperature.

The carpet products which contain the coating or adhesive layers formed form aqueous compositions containing the copolymer dispersions and fillers herein can have a weight per unit area of from about 100 g/m$^2$ to about 3000 g/m$^2$, more preferably from about 200 g/m$^2$ to about 2000 g/m$^2$, most preferably from about 400 g/m$^2$ to about 1500 g/m$^2$ (dry basis).

The carpet products herein can be in the form of rugs or mats which can be used as area floor coverings. Alternatively, the carpet products herein can be in the form of carpet tiles or in the form of wall-to-wall carpeting.

EXAMPLES

The carpet products herein and the copolymer dispersion-containing coating compositions used to make such carpet products are more particularly described with reference to the following non-limiting Examples. The several test methods employed in connection with these Examples are described as follows:

Test Methods

Copolymer Dispersion Particle Size Determination

The size of solid particles within the copolymer dispersions used herein can be determined by laser aerosol spectroscopy (LAS). This LAS method is described in the publication *Kunstharz Nachrichten* 28; "Characterization and Quality Assurance of Polymer Dispersions"; Oktober 1992, Dr. J. Paul Fischer. The method uses a Nd:YVO4 Laser (Millenia II) supplied by Spectra Physics with a laser power of 2 W and a wave length of 532 nm. The detector is a Bialkali Photocathode Typ 4517 supplied by Burle (formerly RCA). The scattered light of the spray dried single particles will be detected at 40°. The evaluation of the data is done with a multi-channel analyzer by TMCA with 1024 channels.

To make the particle size determination, 0.2 ml of a dispersion sample is diluted in 100 ml of deionized and filtered water (conductivity of 18.2 μS/m). The sample is spray dried over a Beckmann-nozzle and dried with nitrogen gas. The single particles are neutralized with beta radiation (Kr-85) and then investigated by single particle laser scattering. After evaluation the number and mass mean values within the range of 80 nm to 550 nm and mean particle size values $d_n$, $d_w$, $d_z$ and $d_w/d_n$ are obtained.

Copolymer Glass Transition Temperature ($T_g$) Determination

The glass transition temperature, $T_g$, can be obtained by using a commercial differential scanning calorimeter Mettler DSC 820 at 10 K/min. For evaluation, the second heating curve is used and the DIN mid point calculated.

Copolymer Dispersion Volatile Organic Compound (VOC) Content (ISO 11890-2)

The total volatile organic compound content of the copolymer dispersion can be measured by using the ISO 11890-2 test method, which test method is incorporated herein by reference. This method determines the residual levels of Volatile Organic Components (VOC) by direct injection into a capillary gas chromatographic column. The method follows the DIN ISO 11890-2 directive where TVOC is defined as the sum of all volatile organic components with a boiling point lower than tetradecane. This component has a boiling point of 253° C.

A Perkin Elmer Gas Chromatograph (Auto system X.L) fitted with PPC (Pneumatic Pressure control) is used with a Varian column V624, 60 meters, 320 μm internal diameter and 1.8 μm film thickness. The carrier gas is $H_2$. The detector is a FID.

For sample preparation, approximately 150 μl of sample is placed into a tared vial using a Gilson Micromann 250 positive displacement pipette. The auto sampler vial is weighed (g), and the result is noted as the divisor value. Approx. 1.5 ml of diluent solution (containing 100 ppm of methyl isobutyl ketone (MIBK) in deionized water as internal standard) is added to the auto sampler vial. The auto sampler vial is weighed (g), and the result is noted as the multiplier. The auto sampler vial is mixed thoroughly using a vortex mixer until the solution in the vial is completely homogenous. The sample vial is then placed on the sampling carousel of the Gas Chromatograph and measured according to ISO 11890-2. Each single VOC is calibrated initially. The result is the sum of all singles VOC values which is the Total Volatile Organic Component (TVOC) parameter in ppm.

Flame Retardancy of Carpet Backing Films (DIN 4102-1)

Samples of dimensions 20×8 cm are cut from carpet backing films prepared with a model formulation. These samples are stored for 14 days at a temperature of 23° C. and 50% humidity prior to making test measurements. The test is performed in a fume cabinet according to DIN 4102-1, which test method is incorporated herein by reference. The samples are put into a supporting frame (downward end is open) marked with graduations to determine flame height. A flame (according to DIN 4102-1) is applied for 15 seconds to the middle of the lower edge of the sample. The samples are allowed to burn until the maximum flame height is reached and is then extinguished.

The results of this test are reported as the self-extinction time in seconds (SET [sec]), the maximum flame height (MFH [mm]), the smoke emission (SE/qualitative evaluation/scale of 1 [low] to 6 [high]) and the amount of ash left after the test (AA/qualitative evaluation/scale of 1 [low] to 6 [high]). The results are reported as the average of 5 measurements.

Flame Retardancy of Carpet Samples with Coating(s) (DIN 4102-14)

The flame retardancy properties of coating-containing carpet samples are evaluated in a flame retardancy test conducted in accordance with the procedures of DIN 4102-14, which test method is incorporated herein by reference. In such testing, the carpet samples to be tested are laid horizontally. Each such sample is heated along its length (sample: 1050±50 mm×230±5 mm) using an inclined radiant heat source (angle of heat source=30°). The sample receives about 11 kW/m$^2$ of heat energy from the heat source at one end and about 1 kW/m$^2$ at the other end. Each test sample is pre-heated for 2 minutes and is then ignited at the hot end. The flame is applied to the sample for 10 minutes and is allowed to burn until the flame goes out (extinction). For all samples, four carpet tiles are tested with one tested in the cross direction and three tested in the machine direction. Results are calculated as the average of all four samples if no significant differences are seen in the four samples.

The heat energy measured at the point of extinction is also determined and is the Critical Heat Flux (CHF). The CHF is defined as the incident heat flux (kW/m$^2$) at the surface of the sample at the point where the flame ceases to advance and may subsequently go out. If after 30 minutes the sample is still burning, the position of the flame front at this time is taken as the point of measurement of the CHF. Also the maximum length of burning (LB) and the time until the sample flame is extinguished (self extinction time SET) are recorded.

Smoke Emission of Carpet Samples with Coating(s) (DIN 4102-14)

Smoke generation is also measured during the flame retardancy test according to DIN 4102-14 as described above over the duration of the test (30 min) Smoke generation is assessed by measuring attenuation of a light beam as such attenuation is caused by smoke from the burning carpet sample. The total amount of light extinction (measured as a percentage) due to the smoke obscuring a light beam in the exhaust duct (flue) is integrated over the whole test time in order to give a result in percent•minutes Tuft Anchorage of Carpet Samples with Coating(s) (ISO 4919)

Three carpet samples having dimensions of 7×20 cm for each type of binder coating to be tested are prepared and stored for a minimum of 24 hours at 23° C. and 50% humidity prior to measurement. The strength of the tuft anchorage in such samples is then measured according to ISO 4919, which test method is incorporated herein by reference.

The testing machine used is made by Lloyd Instruments and is called LF Plus. The test program works with preloaded settings of 0.5 N force and a testing speed of 100 mm/min. The carpet sample is clamped to a mounting which is a stainless steel tray of 10×10 cm/hole Ø5 cm) horizontal. Four fibers (representing one tuft) of the sample are gripped with a compressor. The compressor is attached to the upper clamp of the testing device at an angle of 90° to the sample. The tufts are pulled upward until the tufts separate (break) from the carpet sample.

The maximum break force at tuft separation for each sample is measured. The breakpoint should be reached within 2 to 10 seconds. For each carpet, 20 tufts (3 samples tested/carpet sample with a given binder coating) are tested to give an average for the maximum break force. The break force is measured in Newtons (N).

In connection with this testing, the flexibility of the carpet sample backing is also judged. The samples are bent (folded) to an angle of approximately 180° along the short side of the samples. The samples are then graded on a 1 to 4 scale based on the extent to which the carpet sample backing breaks when bent. In this scale, 1=no break when bent; 2=small breaks/not over the complete folded length; 3=big breaks/not over complete folded length; and 4=one break over complete folded length.

Tuft Anchorage of Carpet Samples with Coating(s) After UV Exposure (ISO 4919)

Three carpet samples having dimensions of 7×20 cm for each type of binder coating are stored in a UV chamber (Suntest XXL form Atlas) for a period of 200 hours. In the chamber the samples are exposed to ultraviolet radiation of wavelength 300-400 nm at an intensity of 60 W/m$^2$. After this time the samples are stored for a minimum of 24 hours at 23° C. and 50% humidity prior to measurement. The samples so prepared are then tested for maximum break force and backing flexibility in the same manner as described above using the test methods of ISO 4919.

Tuft Anchorage of Carpet Samples with Coating(s) After Elevated Temperature Exposure (ISO 4919)

Three carpet samples having dimensions of 7×20 cm for each type of binder coating are stored in a oven (Heraeus) for a period of 200 hours 60° C. After this time the samples are stored for a minimum of 24 hours at 23° C. and 50% humidity prior to measurement. The samples so prepared are then tested for maximum break force and backing flexibility in the same manner as described above using the test methods of ISO 4919.

Emission of Total Volatile Organic Compounds (TVOC) From Copolymer Dispersion Films (ISO 16000-9)

The extent of emission of the Total Volatile Organic Compound (TVOC) content of a copolymer dispersion sample is determined using the general procedures of ISO-16000-9, which test method is incorporated herein by reference. In such a procedure, 2 grams of the copolymer dispersion are weighed into an alumina dish with a diameter of 4.2 cm. The dispersion is dried at room temperature (23 C/50% humidity) overnight to form a film which is then tested in a micro chamber having a diameter of 4.5 cm and a volume of 40 ml. A continuous air flow (100 ml/minute of clean dry air not reconditioned for humidity) is passed through the chamber and the film sample therein is allowed to equilibrate for a period of 20 min to chamber conditions (25° C.).

After 20 minutes, the air flow is directed to an absorption device which is a Tenax tube spiked with 111 ng of Toluene D8 which is used as an absorption standard. The volatile organic compounds (VOCs) in the air flow from the film sample are absorbed onto the Tenax tube for a period of 60 minutes. The Tenax tube is then analyzed via GC-MS for the amount of VOCs absorbed onto it.

The result of the GC-MS measurements are used to give an amount of VOCs absorbed relative to the Toluene D8 standard. If the amount of the toluene standard in the absorbed in the Tenax tube is taken as 1, the amount of VOCs absorbed in the Tenax tube is reported as the number of multiples of 1 represented by the VOCs emitted from the copolymer dispersion film.

Emission of Total Volatile Organic Compound (TVOC) Content from Carpet Samples (ISO 16000-9)

In a procedure analogous to the emission of TVOC content determination for copolymer dispersions, the extent of emission of the TVOC content of carpet samples is also determined in accordance with the general procedures of ISO 16000-9. In this procedure, a carpet sample with a diameter of 4.5 cm is cut from the carpet. This sample is stored for a minimum of 24 hours at 23° C. and 50% humidity and is then measured in the same kind of micro chamber used in the TVOC determination for copolymer dispersions films outlined above. Procedures identical to those described above for TVOC content emitted from the carpet sample in terms of multiples relative to the 111 ng (=1) of the standard Toluene D8.

Example 1

VAE-Based Copolymer Dispersion Preparation

Into a pressure reactor fitted with an anchor stirrer (running at 150 rpm), a heating jacket, dosage pumps and having a volume of 68.6 liters, a water based solution of the following components is added:

| | |
|---|---|
| 19738 g | Water (deionized) |
| 1786 g | Polyvinyl alcohol solution (29%) in deionized water, i.e., partially hydrolyzed [88 hydrolysis (mole %)] that forms a 4% solution viscosity of 4.50 cP ± 0.50 at 20° C. |
| 3149 g | Polyvinyl alcohol solution (15%) in deionized water, i.e., partially hydrolyzed [88 hydrolysis (mole %)] that forms a 4% solution viscosity of 8.50 cP ± 0.50 at 20° C. |
| 80 g | Sodium acetate (anhydrous) |
| 543 g | Sodium vinylsulfonate (30%) |
| 931 g | Alkyl polyglycol ether (28 mols of Ethylene Oxide)-nonionic emulsifier |
| 0.33 g | Mohr's Salt |

The polyvinyl alcohol is dissolved 15%/29% in deionized water at 90° C. for 2 hours. The reactor is purged with nitrogen to eliminate oxygen. Out of a total amount of 28753 g of vinyl acetate, 5% of the vinyl acetate is added to the water phase in the reactor. The ethylene valve is opened and the reactor is pressurized to 15 bar at ambient temperature (ca. 1000 g of ethylene) and is then closed again (total amount of ethylene: 3828 g). The reactor temperature is ramped up to 65° C. At 35° C., 9% of a First Initiator (reducing agent), which is sodium meta bisulfite (44 g in 1043 g of deionized water), is added quickly (over ca. 1-2 minutes) into the reactor. At 50° C., 5% of a Second Initiator (oxidizing agent), which is Trigonox AW-70, (29 g of t-butyl hydroperoxide in 2196 g of deionized water), is added quickly (over ca. 1-2 minutes) into the reactor.

At 65° C., the vinyl acetate feed is started and is introduced into the reactor according to the following profile: 55% in 120 minutes and the remaining 40% in an additional 150 minutes. At the same time, the ethylene valve is opened again until the rest of the ethylene is fed into the reactor. At the same time, all initiator feeds are introduced according to the following profile: 51% of the First Initiator and 55% of the Second Initiator in 120 minutes and the remaining 40% of each initiator in an additional 150 minutes. At 50 minutes before the end of the vinyl acetate feed, the reactor temperature is ramped up over 50 minutes to 85° C. After all of the vinyl acetate and the First and Second Initiators have been introduced, feed of a Third Initiator (33 g of sodium peroxodisulfate in 763 g of deionized water) is started for approximately 10 minutes. The reactor temperature of 85° C. is maintained for 1 hour. The reactor is then cooled down to approximately 40° C. A final redox treatment can be made at this point by introducing Brüggolit FF 6 (a sodium salt of a sulfinic acid derivative, obtained from L. Brüggemann KG) (33 g in 489 g of deionized water) and afterwards Trigonox AW 70 (95).

The Example 1 VAE copolymer dispersion has the following characteristics:

Solids content: 52.7% pH: 5.2

Viscosity Brookfield (25° C., Spindel 4, 20 rpm): 5400 mPas

Residual vinyl acetate: <0.1%

Glass transition temperature, $T_g$, (10 K/min, mid point): 13° C.

Particle size distribution (LAS): $d_w$=297 nm $d_w/d_n$=1.8

TVOC (ISO 11890-2) 960 ppm

Example 2

Alternate VAE-Based Copolymer Dispersion Preparation

Into a pressure reactor fitted with an anchor stirrer (running at 150 rpm), a heating jacket, dosage pumps and having a volume of 68.6 liters, a water based solution of the following components is added:

| | |
|---|---|
| 24454 g | Water (deionized) |
| 1169 g | Polyvinyl alcohol solution (29%) in deionized water, i.e., partially hydrolyzed [88 hydrolysis (mole %)] that forms a 4% solution viscosity of 8.50 cP ± 1.0 at 20° C. |
| 86 g | Sodium acetate (anhydrous) |
| 574 g | Sodium vinylsulfonate (30%) |
| 1453 g | Alkyl polyglycol ether (28 mols of Ethylene Oxide)-nonionic emulsifier |
| 13.6 g | Sodium metabisulfite |
| 0.08 g | Mohr's Salt |

The polyvinyl alcohol is dissolved 29% in deionised water at 90° C. for 2 hours. The reactor is purged with nitrogen to eliminate oxygen. Out of a total amount of 29152 g of vinyl acetate+170 g of glycidyl methacrylate, 9.4% of the vinyl acetate is added to the water phase in the reactor. The ethylene valve is opened, and the reactor is pressurized to 15 bar at ambient temperature (ca. 1000 g of ethylene) and is then closed again (total amount of ethylene: 4746 g). The reactor temperature is ramped up to 65° C. At 35° C., a First Initiator which is sodium peroxo disulfate (114 g in 600 g of deionized water) is added quickly (over ca. 8 minutes) into the reactor.

At 65° C., the vinyl acetate feed is started and is the remaining 90.6% of the vinyl acetate is introduced into the reactor in 240 minutes. At the same time the ethylene valve is opened again until the rest of the ethylene is fed into the reactor. After 210 minutes of vinyl acetate feeding time, a Second Initiator feed (36 g of sodium peroxodisulfate in 600 g of deionized water) is started for approximately 30 minutes. After the vinyl acetate feed is finished, the reactor temperature is ramped up to 85° C. within 30 minutes. This temperature is maintained for another 30 minutes. The reactor is then cooled down to approximately 40° C. A final redox treatment can be made at this point by introducing Brüggolit FF 6 (a sodium salt of a sulfinic acid derivative, obtained from L. Brüggemann KG) (34 g in 508 g of deionized water) and afterwards Trigonox AW 70 (95 g).

The Example 2 VAE copolymer dispersion has the following characteristics:

Solids content: 54.9% pH: 4.3

Viscosity Brookfield (25° C., Spindel 4, 20 rpm): 3100 mPas

Residual vinyl acetate: <0.1%

Glass transition temperature, $T_g$, (10 K/min, mid point): 8° C.

Particle size distribution (LAS): $d_w$=267 nm $d_w/d_n$=1.5

TVOC (ISO 11890-2) 147 ppm

Example 3

Comparative SBL Latex (Litex® T 8466)

A commercially available styrene-butadiene latex (SBL) is obtained and analyzed in order to determine its characteristics in comparison with those of the VAE copolymer dispersions of Examples 1 and 2. The SBL product so characterized is Litex® T 8466, a commercial product of PolymerLatex.

The Example 3 SBL copolymer dispersion has the following characteristics:

Solids content: 51.6% pH: 7.5

Viscosity Brookfield (25° C., Spindel 3, 20 rpm): 340 mPas

Glass transition temperature, $T_g$, (10 K/min, mid point): −1.1° C.

Particle size distribution (LAS): $d_w$=149 nm $d_w/d_n$=1.1

TVOC (11890-2) 254 ppm

Example 4

Model Carpet Backings

(Based on Example 1 and Example 3 Copolymer Dispersions

The VAE copolymer dispersion of Example 1 and the SBL copolymer dispersion of Example 3 are incorporated into filler-containing coating compositions which are then formed into sheets that simulate back coating layers suitable for use in carpet products. The coating compositions are made by mixing the copolymer dispersion with a $CaCO_3$ filler in an IKA RE 166 mixing device to form a homogenous paste. The pastes which are formed comprise 40.0% by weight of the aqueous copolymer dispersion and 60.0% by weight (dry basis) of Carbocia 80, a calcium carbonate material marketed by Carbocia.

The pastes are applied onto 38×27 steel backing trays with a non-stick surface to form an even film on each tray. Add-on amounts of the coating compositions are 2800±200 g/m$^2$. The coated steel trays are dried at room temperature for a minimum of 3 days. The films on the trays are then cut into 20×80 cm rectangles, removed from the trays, and stored in a climate room for a minimum of 14 days at 23° C. and 50% relative humidity.

Example 5

Flame Retardant Testing of Model Carpet Backing Films

The two types of model carpet backing films as described in Example 4 are tested for their flame retardant properties in accordance with the procedures of DIN 4102-1, as outlined hereinbefore in the Test Methods section. For all samples the flame was applied to the middle of the edge of the film samples. The results are the average of 5 tests.

The results of the film flame retardancy testing are reported as the self-extinction time (SET) in seconds, the maximum flame height (MFH) in mm, the qualitative smoke emission (SE) on a scale of 1 (low) to 6 (high), and the qualitative evaluation of the amount of ash (AA) left after the test on a scale of 1 (low=good) to 6 (high=bad). Results are reported in Table 1.

TABLE 1

Flame Retardant Properties of Model Carpet Backing Films

| Co-polymer Type | Manu-facturer | Present Development or Comparative | SET Self-extinction time of flame [seconds] | MFH Max flame height [mm] | SE Smoke emission [1 (low) to 6 (high)] | AA Amount of ash [1 (low) to 6 (high)] |
|---|---|---|---|---|---|---|
| VAE | | Present Development | 19 | 30 | 2 | 1 |
| SBL | Polymer Latex | Comparative | no self extinction | 250 | 6 | 6 |

The Table 1 results for the testing of flame retardant properties of the model carpet backing formulations shows a self-extinction (SET) value for the VAE-based backing compared to the SBL-based backing which does not even extinguish. The VAE-based backing also shows a significant lower flame height (MFH) compared to SBL-based backing. Further, the VAE-based backing exhibits significantly less smoke emission (SE) and amount of ash (AA) compared to the SBL-based backing.

Example 6

Carpet Samples With Coating Layers Based on VAE Copolymers

Carpet samples are prepared on carpet coating apparatus which applies an aqueous coating composition which, upon curing, serves to embed fibrous tufts in a base substrate and to affix a polypropylene scrim to the carpet sample. The coating composition is prepared from the copolymer dispersion of Example 1. The coating composition contains, in addition to the Example 1 aqueous copolymer dispersion, a filler material which is calcium carbonate. This aqueous coating composition has the following formulation, wherein the copolymer dispersion amount is on a wet basis and the filler amount is on a dry basis:

Coating Composition

| Ingredient | Manufacturer | Type | Concentration [%] |
|---|---|---|---|
| Example 1 Copolymer Dispersion | | VAE | 39.4 |
| Synthomer AD208 | Synthomer | Antistatic | 1.4 |
| Carbocia 80 ($CaCO_3$) | Carbocia | Filler | 59.2 |

The carpet base material is constructed with a woven PP base tufting base to support the fibers. The yarn is made of polyamide 66 and is inserted into the tufting base such that the weight of the tufted fibers only is 1275 g/m$^2$ (polweight). The tuft separation is 5/16 (16 needles per 5 inch). The carpet has 40400 naps per square meter. The tuft length of the cut pile carpet is 29 mm.

The scrim substrate which is affixed to the pre-coated tufting base substrate using the coating composition as an adhesive is a dense polypropylene scrim (web weight 75 g/m$^2$/web grid pattern is 4 mm wide in the cross direction and 5 mm wide in the machine direction) available under the trade name Action back from Amoco Company.

The carpet substrate and the scrim substrate can be 3-4 meters wide and are fed through the coating apparatus with a line speed of from 10 to 30 meters per minute. The apparatus must have at least one coating station. After the coating layers are applied, the coated substrate enter a drying section that subjects the coated substrate to drying conditions of 130-200° C. for a period of from 5 to 20 minutes depending on line speed.

The aqueous composition used to form the coating on the carpet samples is introduced into foaming devices fitted with a mixing head and air inlet or other suitable application technology known by those skilled in the art. The foamed coating composition is fed to the respective application sections of the coating apparatus. At the application station, the coating composition is applied to the uncoated base substrate material. After application of the coating composition, the scrim substrate is added to the carpet substrate and pressed slightly into the coating composition layer by means of a roller or other applicators. The carpet substrate with scrim substrate affixed is then fully dried.

Add-on of the coating composition is 1000±200 g/m$^2$. For subsequent testing, rectangular sections of 25×30 cm can be cut from the coated carpet material.

Example 7

Carpet Samples With Coating Layers Based on SBL Copolymers

A comparative carpet product is prepared which is similar to that of Example 6 and is prepared in a manner analogous to that described in Example 6. However, this Example 7 uses a commercially available styrene-butadiene-latex (SBL) copolymer, instead of the VAE copolymer dispersion of the present development, in the coating composition used and is hence a comparative example. The SBL copolymer which is used to prepare the coating composition for this comparative Example 7 is Litex 8466T which is commercially available from PolymerLatex GmbH & Co. KG. and is described above in Example 3.

As in Example 6, the aqueous coating composition also contains, in addition to the SBL copolymer dispersion, a filler material which is calcium carbonate. This Example 7 comparative aqueous coating composition has the following formulation, wherein the copolymer dispersion amount is on a wet basis and the filler amount is on a dry basis:

Coating Composition

| Ingredient | Manufacturer | Type | Concentration [%] |
|---|---|---|---|
| Example 3 Copolymer Dispersion | Polymer Latex | SBL | 36.8 |
| Eurothick 60/2 (acrylic emulsion polymer) | EOC | Thickener | 1.2 |
| Carbocia 80 ($CaCO_3$) | Carbocia | Filler | 62.0 |

Carpet samples are prepared using the foregoing SBL-containing coating composition. As noted above, carpet and scrim substrates, as well as preparation procedures and conditions, are substantially the same as those used for the preparation of the Example 6 carpet samples.

Example 8

Flame Retardant Testing of Coated Carpet Samples

The two types of coated carpet samples as described in Examples 6 and 7 are tested for their flame retardant properties in accordance with the procedures of DIN 4102-14, as outlined hereinbefore in the Test Methods section. Three samples of each carpet type are tested in Machine Direction and 1 sample of each carpet type is tested in Cross Direction. An average is calculated for all 4 samples since no difference occurs by virtue of direction. Only one of the four samples tested in this Example 8 needs to be manually extinguished. The maximum test time is 1800 s (30 min). Average SET is calculated at 1800 s (30 min) Results are the average of the 4 measurements.

Results reported include the Critical Heat Flux (CHF) in $kW/m^2$. The maximum length of burning (LB) and the time until the samples extinguish (SET) are also reported. Results are shown in Table 2.

TABLE 2

Flame Retardant Properties of Carpet Samples

| Co-polymer Type | Manufacturer | Carpet of Example No. | SET Self Extinction Time [s] | LB Max Length of burning [mm] | CHF Critical heat flow = max heat flux [$KW/m^2$] |
|---|---|---|---|---|---|
| VAE | | Example 6 | 550 | 148 | 10.1 |
| SBL | Polymer Latex | Example 7 | 1365 | 403 | 5.2 |

The Table 2 results for the flame retardant properties of the carpet examples show a significant shorter self-extinction time (SET) for the Example 6 VAE based carpet sample compared to the Example 7 SBL-based carpet. Example 6 furthermore shows a significantly higher critical heat flow (CHF) compared to Example 7, i.e., about 2 times higher. Example 6 also shows a significantly shorter burning length compared to Example 7, i.e., about 2.5 times shorter.

Example 9

Smoke Emission Testing of Coated Carpet Samples

The two types of coated carpet samples as described in Examples 6 and 7 are also tested for their smoke emission properties in accordance with the procedures of DIN 4102-14, as outlined hereinbefore in the Test Methods section. The percentage of light beam attenuation caused by the smoke produced from the ignited carpet samples during flame retardancy testing as outlined above is integrated over the total time of the test, thereby providing results in percent•minutes. Smoke emission results are shown in shown in Table 3.

TABLE 3

Smoke Emission of Carpet Samples

| Copolymer Type | Manufacturer | Carpet of Example No. | SE Smoke Emission during 30 min [% min] |
|---|---|---|---|
| VAE | | Example 6 | 23 |
| SBL | Polymer Latex | Example 7 | 274 |

The Table 3 results for smoke emission testing demonstrate that the VAE-based Example 6 carpet sample shows significantly lower smoke emission (SE) compared to the SBL-based Example 7 carpet sample, i.e., about 10 times less.

Example 10

Tuft Anchorage Testing of Coated Carpet Samples

The two types of coated carpet samples as described in Examples 6 and 7 are also tested for Tuft Anchorage according ISO 4919 and for Tuft Anchorage according ISO 4919 after UV exposure and elevated temperature exposure, all as outlined in the Test Methods section above. Carpet backing flexibility is also determined as outlined above.

The maximum break force for tuft separation given in Newtons. Backing flexibility is rated on a scale of 1 to 4, wherein 1=good and 4=bad. Results are shown in Table 4.

TABLE 4

Tuft Anchorage of Carpet Samples

| Co-polymer Type | Example | Tuft Anchorage initial [N] | Tuft Anchorage after 200 h 60° C. [N] | Tuft Anchorage after 200 h UV [N] | Backing Flexibility after 200 h 60° C. [Scale of 1 to 4] | Backing Flexibility after 200 h UV [Scale of 1 to 4] |
|---|---|---|---|---|---|---|
| VAE | Example 6 | 37 | 38 | 42 | 1 | 2 |
| SBL | Example 7 | 54 | 57 | 25 | 2 | 4 |

The Table 4 results show that eth VAE-based Example 6 carpet exhibits comparable initial and elevated temperature Tuft Anchorage compared to the SBL-based Example 7 carpet. Example 6, however, shows better tuft anchorage after 200 h UV compared to Example 7. Example 6 with VAE-based coatings shows a slightly better backing flexibility after 60° C. (aging of the carpet example) compared to Example 7 with SBL-based coatings. Example 6 further shows significantly better Backing Flexibility after UV exposure compared to Example 7.

Example 11

Emission of Volatile Organic Compounds from Copolymer Dispersions and Carpet Samples (ISO 16000-9)

Films formed from the two types of copolymer dispersions as described in Examples 1 and 3, and the two types of carpet samples described in Examples 6 and 7, are all tested for their propensity to emit volatile organic compounds when tested in accordance with the procedures of ISO 16000-9 as described in the Test Methods section above. Results are given as multiples of the Toluene D8 standard (111 ng) represented by the TVOC (Total volatile organic compounds) emitted. Results are shown in Table 5.

TABLE 5

TVOC-Emission from Copolymer Dispersion Films and Carpet Samples

| Copolymer Type | Example No. | Sample Type | TVOC Emitted (Total volatile organic compounds) [No. of Multiple Times Toluene Standard ] |
|---|---|---|---|
| VAE | Example 1 | Copolymer Dispersion Film | 5.4 |
| SBL | Example 3 | Copolymer Dispersion Film | 18.0 |
| VAE | Example 6 | Carpet Sample | 2.1 |
| SBL | Example 7 | Carpet Sample | 21.0 |
| Toluene D8 | | Standard-111 ng | 1 |

The Table 5 results for the TVOC emissions measurement testing of the copolymer dispersion films show that the VAE-based Example 1 copolymer dispersion film exhibits significantly lower TVOC emission compared to the SBL-based Example 3 copolymer dispersion film, i.e., about 3 times lower. The VAE-based Example 6 carpet sample furthermore exhibits significantly lower TVOC emission than the SBL-based Example 7 carpet sample, i.e., about 10 times lower.

The invention claimed is:

1. A carpet product comprising at least one flexible substrate and at least one coating and/or adhesive layer associated with said at least one flexible substrate, said coating and/or adhesive layer being formed from an aqueous composition comprising:

A) an emulsifier-stabilized vinyl acetate/ethylene copolymer dispersion wherein the vinyl acetate/ethylene copolymer therein comprises main co-monomers which include a vinyl acetate co-monomer copolymerized with ethylene; and B) at least one particulate filler material selected from particulate inorganic compounds and particulate plastic material;

wherein:

i) said vinyl acetate/ethylene copolymer in the copolymer dispersion comprises from 4 wt % to 30 wt % of ethylene, based on total main co-monomers therein, ii) said carpet product is substantially free of polyvinyl chloride and bitumen; and iii) said carpet product, in the substantial absence of alumina trihydrate flame retardancy-imparting material, exhibits in accordance with DIN 4102-14, a Class B1 flame-retardancy corresponding to a critical heat flux of ≥about 4.5 kW/m$^2$.

2. The carpet product according to claim 1, wherein said vinyl acetate/ethylene copolymer dispersion has a glass transition temperature, $T_g$, between −20° C. and +20° C.

3. The carpet product according to claim 2 wherein the vinyl acetate/ethylene copolymer comprises one or more additional different non-functional main co-monomer(s) based on vinyl esters of $C_1$-$C_{18}$ mono-carboxylic acids or $C_1$-$C_{18}$ esters of ethylenically unsaturated mono-carboxylic acids or $C_1$-$C_{18}$ diesters of ethylenically unsaturated dicarboxylic acids.

4. The carpet product according to claim 1 wherein said vinyl acetate/ethylene copolymer in the copolymer dispersion is substantially free of cross-linkable co-monomer moieties which generate formaldehyde upon formation of said coating or adhesive layer.

5. The carpet product according to claim 1 wherein the vinyl ester/ethylene copolymer dispersion has a particle size, dw, ranging from 50 to 500 nm as determined by Laser Aerosol Spectroscopy.

6. The carpet product according to claim 2 wherein the vinyl ester/ethylene copolymer of the copolymer dispersion comprises up to 40 wt %, based on total main monomers therein, of additional different non-functional main co-monomer(s) which are copolymerizable with said vinyl acetate and ethylene co-monomers.

7. The carpet product according to claim 1 wherein the vinyl ester copolymer of the copolymer dispersion comprises up to 5 wt %, based on total main monomers therein, of additional functional co-monomers copolymerizable with said main co-monomers, said additional functional co-monomers being selected from ethylenically unsaturated acids, or the salts thereof, ethylenically unsaturated monomers having at least one amide, epoxy, hydroxyl, trialkoxysilane or carbonyl group, and combinations of two or more co-monomers from any of said additional functional co-monomer types.

8. The carpet product according to claim 1 wherein the vinyl ester/ethylene copolymer of the copolymer dispersion comprises an additional ethylenically unsaturated cross-linking co-monomer having an epoxy group.

9. The carpet product according to claim 8 wherein the cross-linking co-monomer in the vinyl acetate-ethylene copolymer of the copolymer dispersion is selected from glycidyl acrylate, glycidyl methacrylate, allyl glycidyl ether, vinyl glycidyl ether, and combinations of said cross-linking co-monomers.

10. The carpet product according to claim 2 wherein the glass transition temperature, Tg, of the vinyl ester/ethylene copolymer of the copolymer dispersion ranges between −10° C. and +15° C.

11. The carpet product according to claim 1 wherein said copolymer dispersion is stabilized with at least 0.5 wt %, based on total main co-monomers in said copolymer, of one or more emulsifiers and from 0 wt % to 3 wt %, based on total main co-monomers in said copolymer, of a protective colloid.

12. The carpet product according to any claim 1 wherein the copolymer dispersion has a Total Volatile Organic Compound (TVOC) content, as determined by ISO 11890-2, of less than 1.0% based on the total weight of the aqueous copolymer dispersion.

13. The carpet product according to claim 1 wherein a film formed from the copolymer dispersion emits its TVOC content to the extent of no more than 15 times relative to the toluene standard when tested in accordance with the procedures of ISO 16000-9.

14. The carpet product according to claim 1 wherein the copolymer dispersion forms a model backing film which exhibits a flame self-extinction time of less than 30 seconds, a maximum flame height of less than 50 mm, a smoke emission rating of less than 3 and an ash production rating of less than 3 when tested in accordance with the procedures of DIN 4102-1.

15. The carpet product according to claim 1 which emits its TVOC content to the extent of no more than 5 times relative to the toluene standard when tested in accordance with the procedures of ISO 16000-9.

16. The carpet product according to claim 1 which comprises at least one binder coating and at least one separate adhesive layer, each of which is different in composition from the other.

17. The carpet product according to claim 1 wherein the flexible substrate therein is selected from nonwovens, wovens, unidirectional weaves, knitted fabrics and pile fabrics.

18. A carpet product comprising at least one flexible substrate and at least one binder coating layer associated with said at least one flexible substrate, said binder coating layer being formed from an aqueous composition comprising:

A) an emulsifier-stabilized vinyl acetate/ethylene copolymer dispersion wherein the vinyl acetate/ethylene copolymer therein has an ethylene content of from 8 wt % to 25 wt % based on total of vinyl acetate and ethylene co-monomers and a glass transition temperature, Tg, of from −10° C. to +15° C.; and B) at least one particulate filler material selected from particulate calcium carbonate and particulate plastic material;

wherein i) said vinyl acetate/ethylene copolymer in the copolymer dispersion is substantially free of N-methylol acrylamide cross-linkable co-monomer moieties and the low formaldehyde generating variants thereof and further comprises no other cross-linkable moieties which generate formaldehyde upon formation of said coating or adhesive layer;

ii) said vinyl acetate/ethylene copolymer in the copolymer dispersion has a particle size, dw, ranging from 120 to 350 nm as determined by Laser Aerosol Spectroscopy;

iii) said copolymer dispersion is emulsifier-stabilized with a combination of at least 0.5 wt %, based on total monomers in said copolymer, of one or more nonionic and/or anionic emulsifiers and from 0 wt % to 3.0 wt %, based on total vinyl acetate and ethylene co-monomers in said copolymer, of a polyvinyl alcohol protective colloid;

iv) the solids content in said aqueous composition comprises from 2.5 wt % to 50 wt % of copolymer solids and from 50 wt % to 97.5 wt % of particulate filler material;

v) said carpet product is substantially free of polyvinyl chloride and bitumen; and vi) said carpet product, in the absence of alumina trihydrate flame retardancy-imparting material, exhibits in accordance with DIN 4102-14, a Class B1 flame-retardancy corresponding to a critical heat flux of more than 6.0 $kW/m^2$; a self extinction of burning time of less than 700 seconds; a maximum burning length of less than 300 mm; and a smoke density value of less than 200%-minutes.

* * * * *